US012747576B2

(12) United States Patent
Masroor et al.

(10) Patent No.: US 12,747,576 B2
(45) Date of Patent: Sep. 29, 2026

(54) POST TENSION AND CANTILEVER CONNECTION ASSEMBLY FOR A MODULAR CONSTRUCTION

(71) Applicant: Cassette, Inc., Los Angeles, CA (US)

(72) Inventors: Armin Masroor, San Jose, CA (US); Dafna Kaplan, Los Angeles, CA (US); Craig Hodgetts, Culver City, CA (US); Dennis Rustad, Irvine, CA (US)

(73) Assignee: Cassette Inc.

( * ) Notice: Subject to any disclaimer, the term of this patent is extended or adjusted under 35 U.S.C. 154(b) by 357 days.

(21) Appl. No.: 18/535,461

(22) Filed: Dec. 11, 2023

(65) Prior Publication Data

US 2024/0191495 A1 Jun. 13, 2024

Related U.S. Application Data

(60) Provisional application No. 63/431,860, filed on Dec. 12, 2022.

(51) Int. Cl.
*E04B 1/24* (2006.01)
*E04B 1/348* (2006.01)

(52) U.S. Cl.
CPC ..... *E04B 1/2403* (2013.01); *E04B 1/3483* (2013.01); *E04B 2001/2415* (2013.01); *E04B 2001/2448* (2013.01); *E04B 2001/2457* (2013.01); *E04B 2001/246* (2013.01)

(58) Field of Classification Search
CPC ..... E04B 1/2403; E04B 1/3483; E04B 1/343; E04B 1/34807; E04B 2001/2415; E04B 2001/1915
USPC ..... 52/79.12, 79.1
See application file for complete search history.

(56) References Cited

U.S. PATENT DOCUMENTS

| | | | | |
|---|---|---|---|---|
| 3,716,957 | A * | 2/1973 | Bernardi | E04B 1/5812 52/837 |
| 5,735,639 | A * | 4/1998 | Payne | B65D 90/0013 588/259 |
| 10,415,230 | B1 * | 9/2019 | Abbas | E04B 1/98 |
| 11,105,088 | B2 * | 8/2021 | Binder | E04C 3/07 |
| 2007/0209314 | A1 * | 9/2007 | Vaughn | E04B 1/24 52/838 |
| 2007/0271857 | A1 * | 11/2007 | Heather | B65D 88/022 52/79.9 |

(Continued)

*Primary Examiner* — Paola Agudelo
(74) *Attorney, Agent, or Firm* — MH2 Technology Law Group LLP

(57) ABSTRACT

A vertical structural connection assembly allowing a modular construction to be made with a plurality of modular units without any required welding on-site. A pin on top of each column of the modular units allows construction crews to easily stack the units one on top of one another. A cantilever plate is included within the connection assembly which is configured to couple to a cantilever beam, thereby providing a means for a corridor, balcony, overhanging roof, or other construction element to be added to the modular construction. A tie connection attaches on the face of the modular units via a welded bolt or outrigger, and/or placed on adjacent connection assemblies between stacked modular units. The tie connection maintains the horizontal connection while allowing adjacent modular unit to move up and down independently, for example, during a seismic event, while still maintaining a horizontal distance there between.

13 Claims, 11 Drawing Sheets

(56) References Cited

U.S. PATENT DOCUMENTS

| | | | | |
|---|---|---|---|---|
| 2012/0176011 | A1* | 7/2012 | Carr | E04H 5/02 312/236 |
| 2019/0136504 | A1* | 5/2019 | Burgess | E04B 1/1903 |
| 2022/0002991 | A1* | 1/2022 | Austin | E04B 5/40 |
| 2022/0251829 | A1* | 8/2022 | Pospisil | B32B 15/14 |
| 2023/0121784 | A1* | 4/2023 | Del Rio | E04B 1/2403 52/215 |
| 2023/0125829 | A1* | 4/2023 | Parkhouse | E04B 1/3483 52/79.13 |
| 2023/0145279 | A1* | 5/2023 | Snorrason | E04B 1/34861 52/79.1 |
| 2023/0228079 | A1* | 7/2023 | Batukan | E04B 1/34384 52/79.1 |

* cited by examiner

POST TENSION AND CANTILEVER CONNECTION ASSEMBLY FOR A MODULAR CONSTRUCTION

BACKGROUND

Field of the Technology

The invention relates to the field of assembling modular construction units, and in particular a method and apparatus allowing for modular construction units to be stacked on one another without additional welding.

Description of the Prior Art

Modular construction is a type of construction whereby components of a building are prefabricated in modular assemblies offsite and are then assembled onsite into a finished building, in conjunction with site-built elements. Modular construction processes save significant time on a construction site, so the more that pre-assembly offsite is possible, often the lower the cost and greater the savings for the user.

Modular units must be structurally connected in a way that forms the resulting structure of the finished building, and many of the existing forms of connection produce unwanted consequences that can be structural, economic for the real estate developer, or aesthetic in nature. This can be especially challenging when constructing in seismic zones, where the right balance of rigidity and flexibility in a system are difficult to achieve economically and with standard off-the-shelf parts.

For example, existing steel systems when stacked in a seismically active zone will fail without the additional presence of a steel structure exterior to the modules bracing them in place. Such external structures are costly and take extra time to construct on-site. Traditional steel welding on a construction site is also quite costly.

Previous vertical post-tensioning connection systems, such as the POSCO horizontal connector plate, patented in South Korea, allows for a vertical post-tension cable to pass through it while connecting units horizontally one-to-another on each level of the building. However, when analyzed through an FEA method for U.S. seismic zones, the units need to be placed too far apart to be economical as too much real estate is wasted between columns of adjacent units. Furthermore, these plates have structural failures after only 2-3 stories.

BRIEF SUMMARY

The current invention solves several known challenges with modular construction, namely wherein modular prefabricated units or apartments are stacked adjacent to one another, for example below, on top of, and next to each other. The current structural system for stacking volumetric modular units solves many of the problems which have eluded earlier attempts from all around the world. The current structural system enables higher stacks, i.e. in some cases up to 6 stories, of steel module frames to be formed that are self-supporting seismically and, even without an adjacent stack or exterior structure, they are sufficiently strong to carry both the gravity and lateral loads of seismic movement. This presents significant time and cost savings on the construction site where they are used. The current invention does this primarily by facilitating a vertical post-tensioned structural connection vertically through the columns of the modular frames, with a few unique features of the column endpoints where the post-tensioning cable or rod passes through. The current invention allows a modular building to be created without any required welding on-site. Instead, using vertical post tensioning and a uniquely designed "pin" on top of each column allows construction crews to easily stack the units one on top of the other due to the tapered shape of the pin. A penetration in the pin allows it to dually serve as a pick point for the rigging crew to attach the lifting lugs for craning the module off of the truck and into place within the larger overall modular construction. The pin has a vertical penetration that allows for the post-tensioning cable to run through it and through the column to tie together the structure of the building. The current invention enables a modular frame to be connected vertically with the benefits of a post-tension system (faster stacking, no welding on-site) while reducing the horizontal connection between modules (and modular stacks) to a simple adjustable rod or tie connection between each horizontally adjacent module. The tie connection can be a readily available, off the shelf product, and attaches on the face of the units to a welded bolt or outrigger at the top and/or bottom of each module frame, and/or placed on a shim plate between stacked units that receives the readily available adjustable rod. The tie connection maintains the horizontal connection while allowing columns to move up and down independently.

Many modular frames are typically custom-designed and custom-manufactured for each unique project and site condition which makes it difficult for a modular product maker to achieve efficiencies of scale by keeping the frames the same for every single production run. The current invention allows the factory to make every frame and corner column identical in the factory and use interchangeable, non-welded plates atop the nodes to support different building conditions such as balconies and/or corridors in the field. This again makes the stacking and assembly process faster in the field and reduces the need for skilled labor to assemble the units with support features on site.

In certain embodiments, the components of this feature and interchangeable plates include column tops which have a welded square plate on the face that functions as a support for a site-placed corridor/balcony support plate. Each column top has penetrations to fit around the welded bolts that are disposed on top of each column.

In certain other embodiments, flat plates are used at each column node after a unit is installed on-site, before another unit is stacked above. Flat plate variations have any necessary penetrations to fit around drift pins or column nodes on the tops of units. Flat plates can be shaped as square corner plates that are flush with the face of the module and serve simply to shim the module to a height that matches other plates atop the other columns. Additionally, flat plates may also be longer, more rectangular plates that are placed in the same location but which extend past the face of the module in varying lengths to support various lengths of balconies or corridors, depending on the rest of the building design. In the case of a corridor or balcony, once another module is placed on top of all the shim and support plates that are disposed on the lower module, the longer plates serve as a support to which other building structures may be bolted.

The current invention provides a connection assembly for a modular construction. The connection assembly comprises a side plate coupled to a first modular unit, a cantilever plate disposed between the first modular unit and a second modular unit, and an end plate coupled to a cantilever beam. The second modular unit is disposed on top of the first modular unit.

In one embodiment, the side plate is coupled to a vertical surface of a column of the first modular unit, and the cantilever plate is disposed over a top surface of the column of the first modular unit.

In another embodiment, the end plate coupled to the cantilever beam is removably coupled to the side plate, and where the cantilever plate is removably coupled to the cantilever beam.

In a further embodiment, the cantilever plate disposed between the first modular unit and the second modular unit is disposed across a corresponding cross sectional area of a first column within the first modular unit and a second column within the second modular unit.

In one embodiment, the connection assembly also comprises at least one means for fastening disposed through the side plate, and a tie connection removably coupled to the at least one means for fastening disposed through the side plate. The at least one means for fastening that is disposed through the side plate is specifically disposed through the end plate coupled to the cantilever beam. Additionally, the tie connection is configured to rotate about the at least one fastening means disposed through the side plate, according to certain embodiments.

In another embodiment, the cantilever plate comprises at least one guide pin and a cable pin. The cable pin comprises a shaft defined through its vertical height.

The invention also provides a modular construction comprising at least two modular units, a connection assembly coupled to each of the at least two modular units, and a tie connection coupled to each connection assembly that is coupled to each of at least two modular units. The at least two modular units are disposed horizontally adjacent to each other, according to certain embodiments.

In another embodiment, the construction assembly coupled each of the at least two modular units comprises a side plate coupled to one of the at least two modular units, a cantilever plate disposed on top of one of the at least two modular units, and a first plurality of fasteners configured to couple the cantilever plate to a cantilever beam. Here, each connection assembly further comprises an end plate coupled to the cantilever beam and a second plurality of fasteners configured to couple the end plate coupled to the cantilever beam to the side plate coupled to each of the at least two modular units. According to certain embodiments, the tie connection coupled to each connection assembly is coupled to the at least two of the second plurality of fasteners. The tie connection is further configured to rotate about the at least two of the second plurality of fasteners.

In one particular embodiment, the cantilever plate comprises at least one guide pin and a cable pin, where the cable pin comprises a shaft defined through its vertical height.

The invention also provides a method for constructing a modular construction, the method comprising disposing a first modular unit horizontally adjacent to a second modular unit, disposing a cantilever plate on a top surface of the first and second modular units, and then stacking a third modular unit on top of the cantilever plate disposed on either the first or second modular unit. Next, a tie connector is coupled to at least one fastener disposed on the first modular unit and to at least one fastener disposed on the second modular unit.

In one embodiment, the method further comprises disposing a compressible pad between the first and second modular units.

In another embodiment, the method also includes coupling a cantilever beam to the cantilever plate disposed on either the first or second modular unit and then coupling the cantilever beam to a side plate coupled to either the first or second modular unit.

In a further embodiment, stacking the third modular unit on top of the cantilever plate disposed on either the first or second modular unit specifically comprises inserting at least one guide pin disposed on the cantilever plate into the third modular unit.

According to one embodiment, stacking the third modular unit on top of the cantilever plate disposed on either the first or second modular unit comprises inserting a cable pin disposed on the cantilever plate into the third modular unit and then disposing a conduit within the third modular unit through a shaft defined through a vertical height of the cable pin and into either the first or second modular unit.

In a further embodiment, the method includes compensating for relative vertical movement between the first and second modular units by rotating each lateral end of the tie connector about the at least one fastener disposed on the first modular unit and the at least one fastener disposed on the second modular unit, respectively.

While the apparatus and method has or will be described for the sake of grammatical fluidity with functional explanations, it is to be expressly understood that the claims, unless expressly formulated under 35 USC 112, are not to be construed as necessarily limited in any way by the construction of "means" or "steps" limitations, but are to be accorded the full scope of the meaning and equivalents of the definition provided by the claims under the judicial doctrine of equivalents, and in the case where the claims are expressly formulated under 35 USC 112 are to be accorded full statutory equivalents under 35 USC 112. The disclosure can be better visualized by turning now to the following drawings wherein like elements are referenced by like numerals.

BRIEF DESCRIPTION OF THE DRAWINGS

FIG. 6 is a top down view of a modular construction comprising a pair of modular units, each of the modular units comprising a connection assembly of FIGS. 2A-2D and a tie connection disposed there between.

The disclosure and its various embodiments can now be better understood by turning to the following detailed description of the preferred embodiments which are presented as illustrated examples of the embodiments defined in the claims. It is expressly understood that the embodiments as defined by the claims may be broader than the illustrated embodiments described below.

DETAILED DESCRIPTION OF THE PREFERRED EMBODIMENTS

Figure 1:
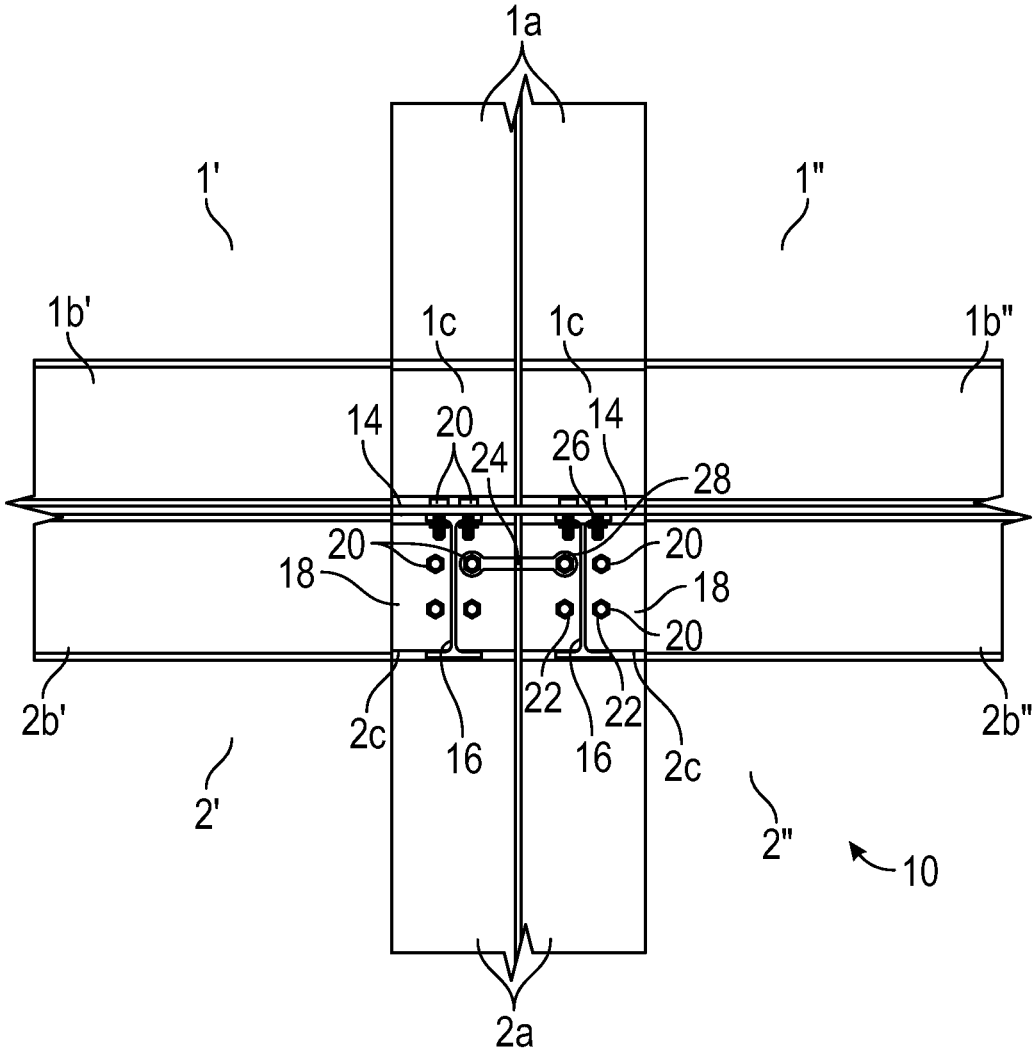
FIG. 1 is a frontal view of a pair connection assemblies coupling a plurality of modular units together and a tie connection coupled to one of the connection assemblies at either lateral end.

Greater detail of the current invention may be seen in FIGS. 1-3 which show an example of the current modular unit connection assembly denoted generally by reference numeral 10. The connection assembly 10 is seen in FIG. 1 when it is used in conjunction with four adjacently disposed modular units, namely two laterally adjacently disposed upper units 1', 1" and two laterally adjacently disposed lower units 2', 2". Each of the upper and lower units 1, 2 comprise a plurality of vertically orientated columns 1*a*, 2*a*, as well as a plurality of horizontally orientated beams 1*b*, 2*b*. Where a column 1*a*, 2*a* meets a beam 1*b*, 2*b*, a corresponding corner junction 1*c*, 2*c* is formed. For purposes of clarity, the beams of the left most units 1', 2' as seen in FIG. 1 are labeled as 1*b'*, 2*b"*, while the beams of the right most units 1", 2" are labeled as 1*b"*, 2*b"*.

Figure 2A:
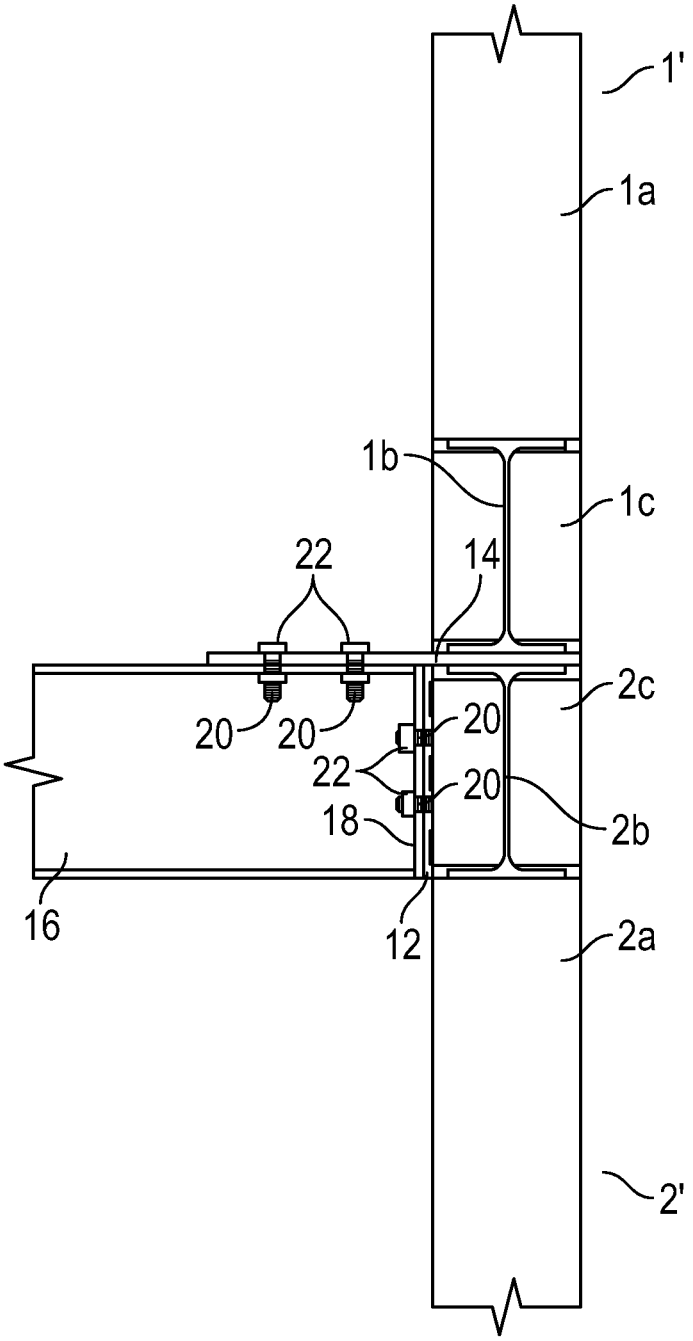
FIG. 2A is a right side cross sectional view of the connection assemblies of FIG. 1.
Figure 2B:
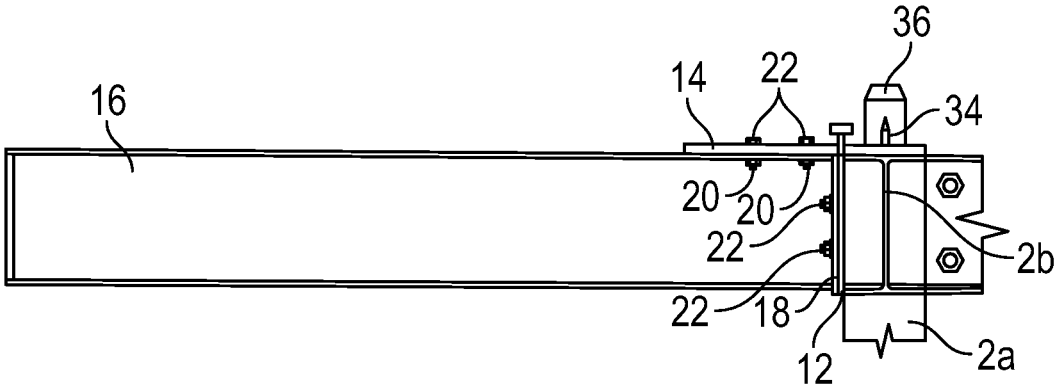
FIG. 2B is a right side cross sectional view of one of the connection assemblies of FIG. 2A with a top modular unit removed for clarity purposes.
Figure 2C:
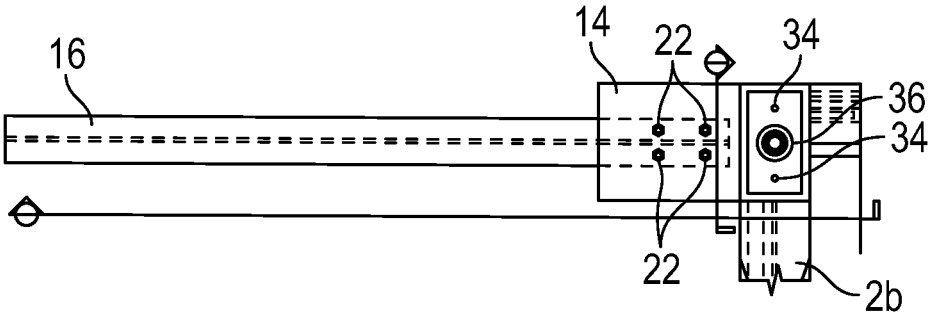
FIG. 2C is a top down view of the connection assembly of FIG. 2B.
Figure 2D:
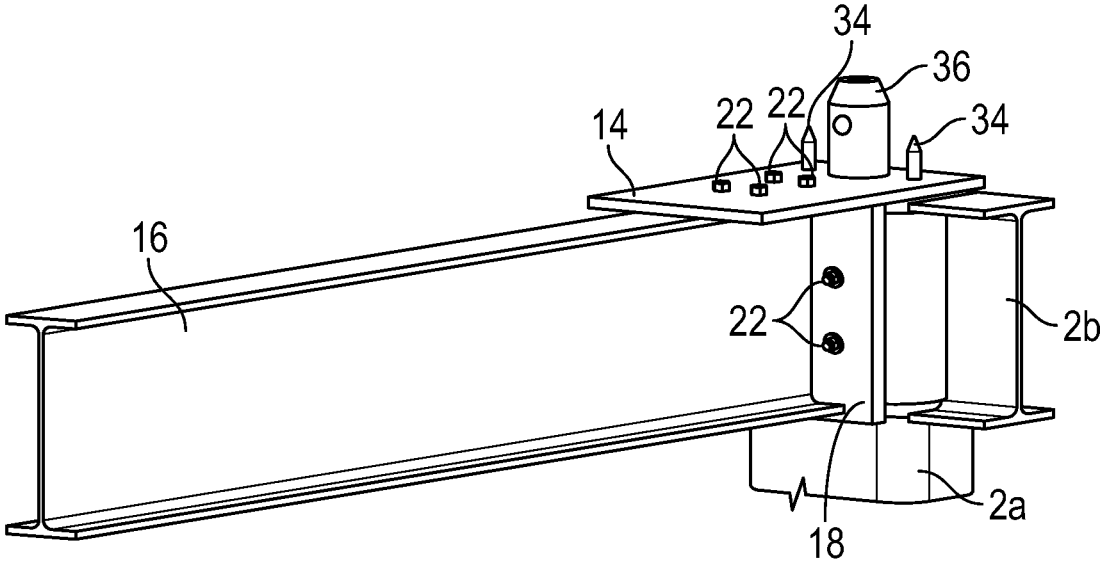
FIG. 2D is a perspective view of the connection assembly of FIG. 2B.
Figure 3A:
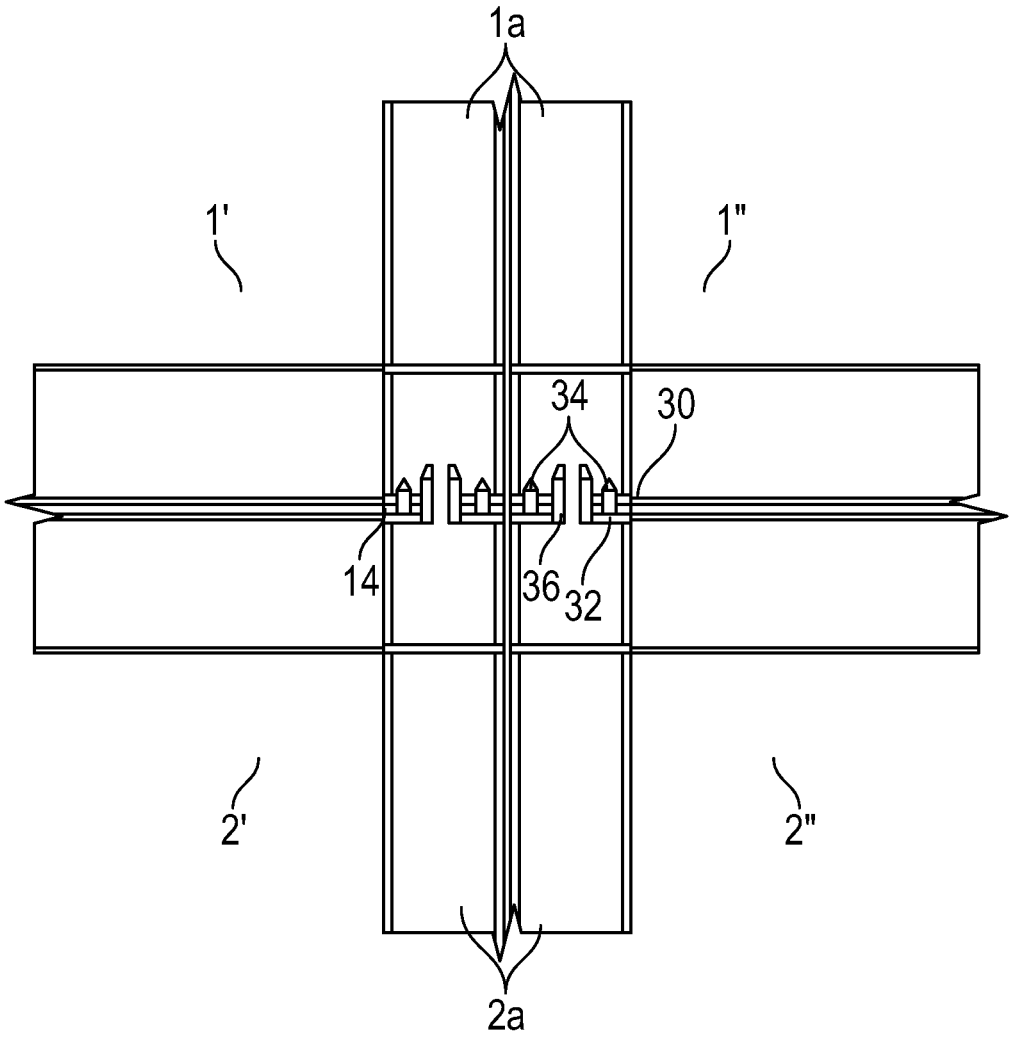
FIG. 3A is a frontal cross sectional view of the pair connection assemblies of FIG. 1 coupling the plurality of modular units together, wherein the cable pin and guide pins of each connection assembly are visible.

In certain embodiments, the corner conjunction 2*c* of each of the adjacent lower units 2', 2" comprises a side plate 12 that is coupled to a column's outer surface as best seen in FIGS. 2A and 2B. FIG. 2A is a side cross sectional view of the connection assembly 10 seen in FIG. 1, while FIGS. 2B-2D illustrate the same connection assembly 10 with the upper modular unit 1' removed for clarity purposes. According to certain embodiments, the side plate 12 is welded to the outer surface of the corner conjunction 2*c*, however other known construction means such as bolts, adhesives, or other fixtures may also be used. In certain embodiments, each side plate 12 is preferably comprised of metal or metal alloys, however other equivalent materials may also be used without departing from the spirit and scope of the invention. Additionally, each side plate 12 may be coupled to the outside surface of the modular unit 1, 2 where each respective corner junction 2*c* is disposed, however in other embodiments each side plate 12 may be coupled directly to the column 2*a* and/or the beam 2*b* which forms the corner junction 2*c* itself.

Figure 7A:
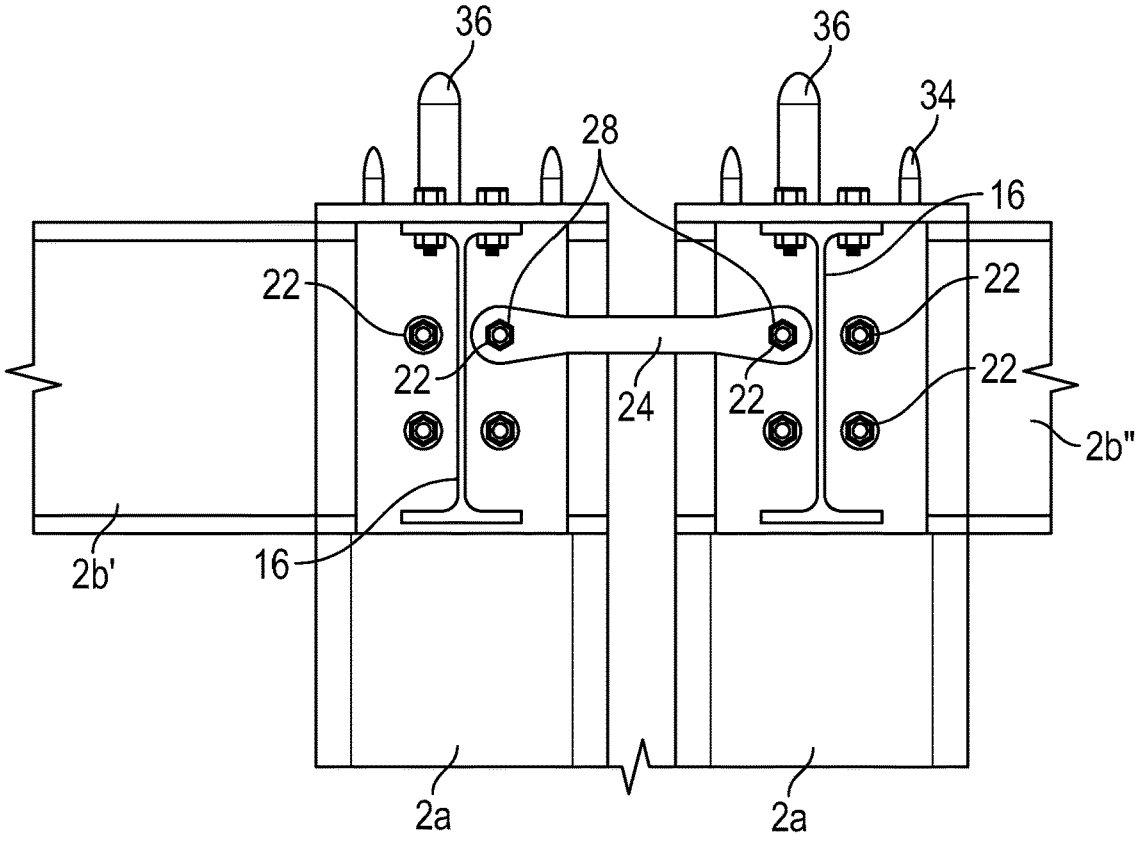
FIG. 7A is a magnified frontal view of two adjacent modular units comprising a tie connection comprising a single rigid body, each lateral end of the tie connection coupled to an end plate portion of a cantilever beam that is in turn coupled to a connection assembly of FIGS. 1-2D disposed on each of the modular units.

The connection assembly 10 further comprises a cantilever plate 14 which is configured to be inserted, slid, or otherwise disposed between the top of the column 2*a* of a lower unit 2', 2" and the bottom of the column 1*a* of an upper unit 1', 1". The cantilever plate 14 is preferably comprised of metal or metal alloys, however in other embodiments other materials such as plastic or plastic composites, rubber, or other equivalent materials may also be used. As best seen in FIGS. 2A-2C, the cantilever plate 14 is disposed across the cross sectional area defined between the columns 1*a*, 2*a* and extends outward in a perpendicular orientation relative to a vertical axis of the columns 1*a*, 2*a* of the modular units 1, 2. In certain embodiments, each corner junction 2*c* comprises its own corresponding cantilever plate 14, therefore when two adjacent lower modular units 2', 2" are disposed next to one another as seen in FIGS. 1, 5A, and 7A, both the side plates 12 and their respective cantilever plates 14 are also adjacently disposed to one another in parallel and separated by a relatively small horizontal distance.

Figure 3B:
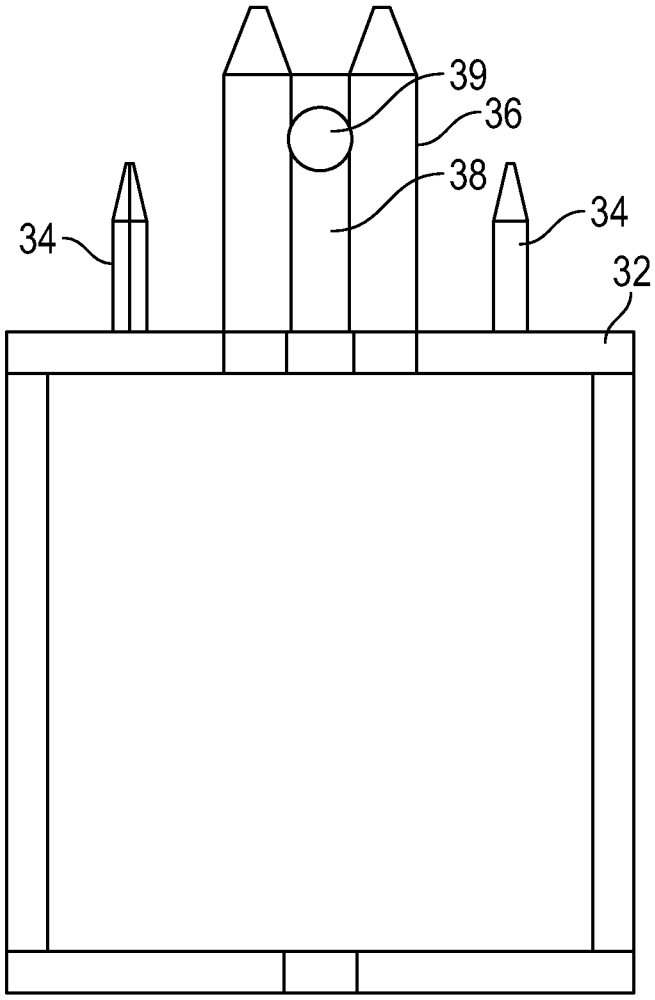
FIG. 3B is a magnified cross sectional view of the cable pin and guide pins of FIG. 3A.

According to certain embodiments, each cantilever plate 14 may be held in place between an upper modular unit 1 and lower modular unit 2 by the weight of the upper modular unit 1 pressing down upon the cantilever plate 14, however in certain embodiments the cantilever plate 14 may be coupled to either or both of the upper and lower modular units 1, 2 by a weld, adhesive, or other coupling means. In certain embodiments, coupling between an upper modular unit 1', 1" and a lower modular unit 2', 2" is done using a column end cap 30 as seen in the cross section view of FIG. 3A and the magnified view of FIG. 3B. Each column end cap 30 comprises a lower plate 32 disposed below the cantilever plate 14. According to some embodiments, the lower plate 32 forms a portion of the cantilever plate 14, however in other embodiments, the lower plate 32 is a separate component which is coupled directly to the modular unit. In certain embodiments the lower plate 32 comprises a plurality of drift pins 34 and a cable pin 36 extending vertically from the lower plate 32, through a corresponding or matching set of apertures or penetrations defined in the cantilever plate 14, and terminating within a bottom portion of the column 1*a* of the upper modular unit 1. The plurality of drift pins 34 and cable pin 36 help limit the relative movement between the upper modular unit 1 and the lower modular unit 2 once connected, as well as serve as connection points for construction workers to quickly and easily dispose and align each upper modular unit 1 with the lower modular unit 2 to be disposed directly beneath it. Greater detail of the cable pin 36 is seen in FIG. 3B which illustrates a cross sectional view of the cable pin 36. In certain embodiments, the cable pin 36 comprises a hollow, vertically orientated shaft 38 defined through the height of the cable pin 36, as well as an aperture 39 defined through the diameter of the cable pin 36. The vertical shaft 38 allows cables, electrical lines, plumbing, and other conduits inserted through the corresponding columns 1*a*, 2*a* of the modular units 1, 2 to be easily passed there through so that they may be connected to the entire modular construction 100, regardless of how many stories the completed or final modular construction 100 may have. The aperture 39 in turn provides a purchase point or means for a crane or other piece of construction equipment to grip or couple to the modular unit 1, 2 so as to assist in the transportation and stacking of the modular unit 1, 2.

Returning to FIGS. 2A-2D, according to certain embodiments a cantilever beam 16 is coupled to the connection assembly 10 through an end plate 18 which is in turn coupled to a lateral end of the cantilever beam 16. The end plate 18 is preferably comprised of metal or metal alloys, however other equivalent materials may also be used. The end plate 18 is also preferably coupled to a lateral end of the cantilever beam 16 by a weld, however other coupling means such as bolts or other fixtures may also be used. In one embodiment, to couple the cantilever beam 16 to the side plate 12 of the connection assembly 10, a plurality of apertures or perforations defined in the end plate 18 are aligned with a corresponding plurality of apertures or perforations defined in the side plate 12. A plurality of bolts 20 or another fixture now known or later devised are inserted therethrough and then fixed into place by a corresponding plurality of nuts 22 or other coupling means, thereby coupling the end plate 18 of the cantilever beam 16 directly to the side plate 12 of the connection assembly 10. A second plurality of bolts 20 are threaded through the cantilever plate 14 and directly into a plurality of apertures defined in a top surface of the cantilever beam 16, thereby coupling a bottom surface of the cantilever plate 14 to the top surface of the cantilever beam 16. The same process may be repeated for the adjacent connection assembly 10, thereby providing a parallel pair of cantilever beams 16 extending outward from the stack of modular units 1, 2. In one embodiment, the bolts 20 and nuts 22 used to couple the end plate 18 to the side plate 12 are identical to the bolts 20 and nuts used to couple the cantilever plate 14 to the cantilever beam 16, however in certain embodiments, the bolts 20 and nuts 22 used to couple the end plate 18 to the side plate 12 may differ in size from those used to couple the cantilever plate 14 to the cantilever beam 16.

Figure 5A:
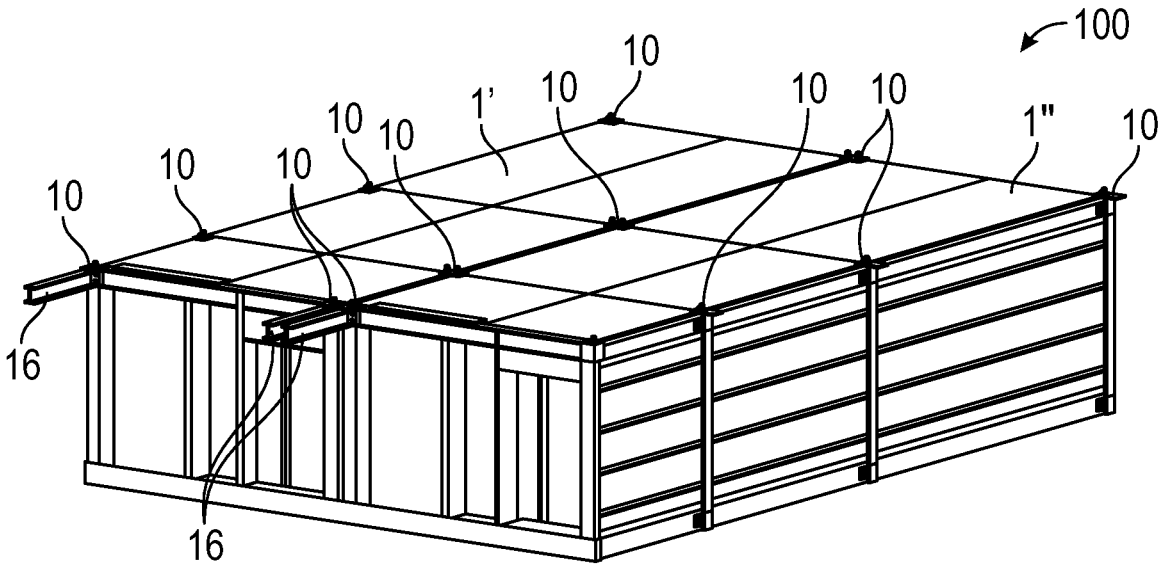
FIG. 5A is a perspective view of a modular construction comprising a pair of modular units, each of the modular units comprising a plurality of connection assemblies of FIGS. 2A-2D.
Figure 5B:
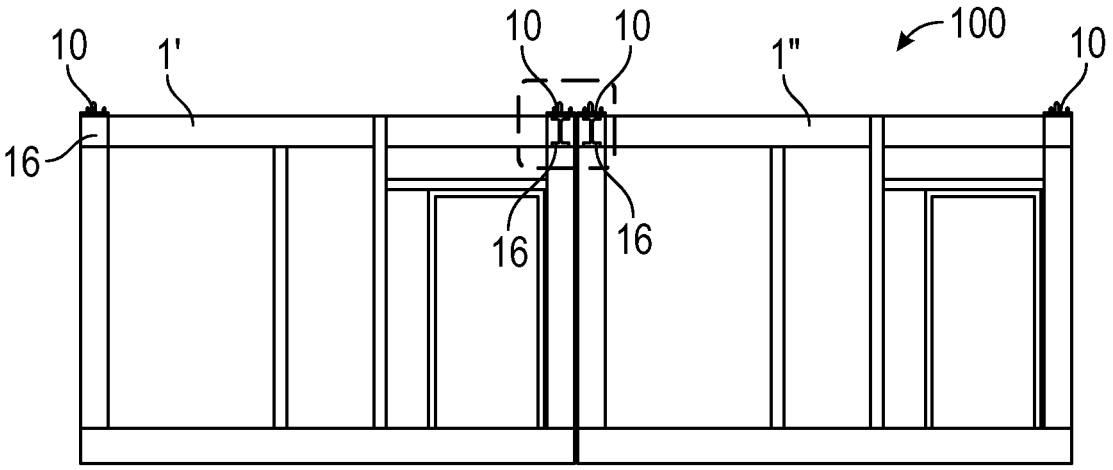
FIG. 5B is a frontal view of the modular construction of FIG. 5A.
Figure 5C:
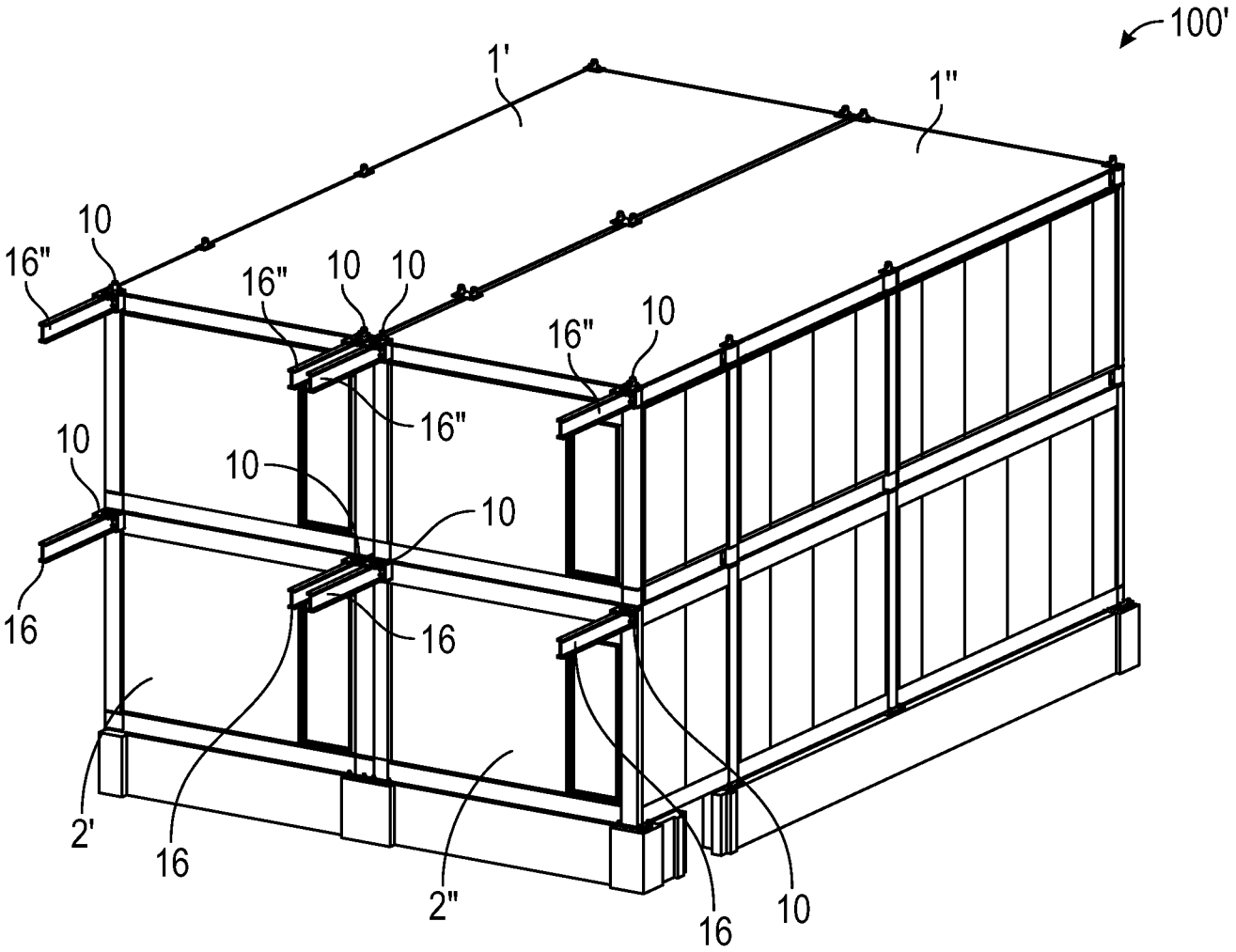
FIG. 5C is a perspective view of a modular construction comprising a plurality of modular units disposed in a multiple-story configuration, each of the plurality of modular units comprising a plurality of connection assemblies of FIGS. 2A-2D.
Figure 6:
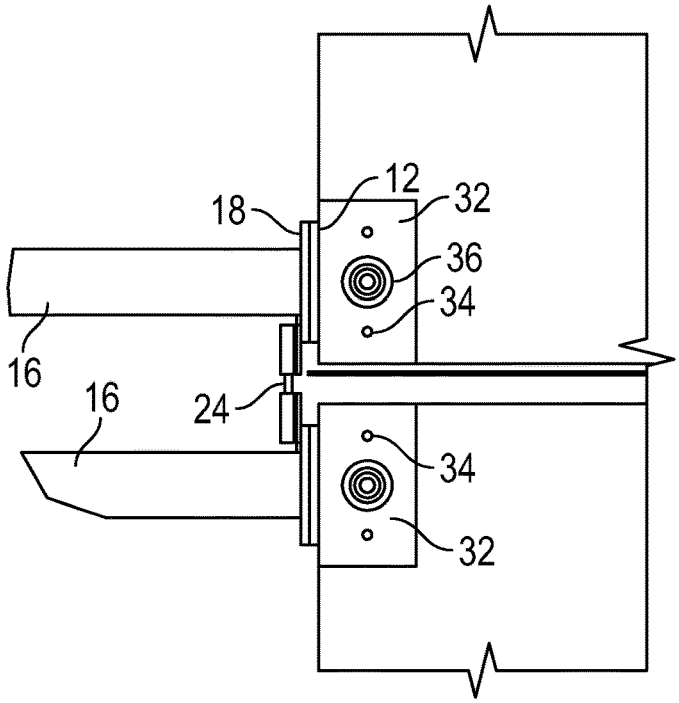
Figure 11:
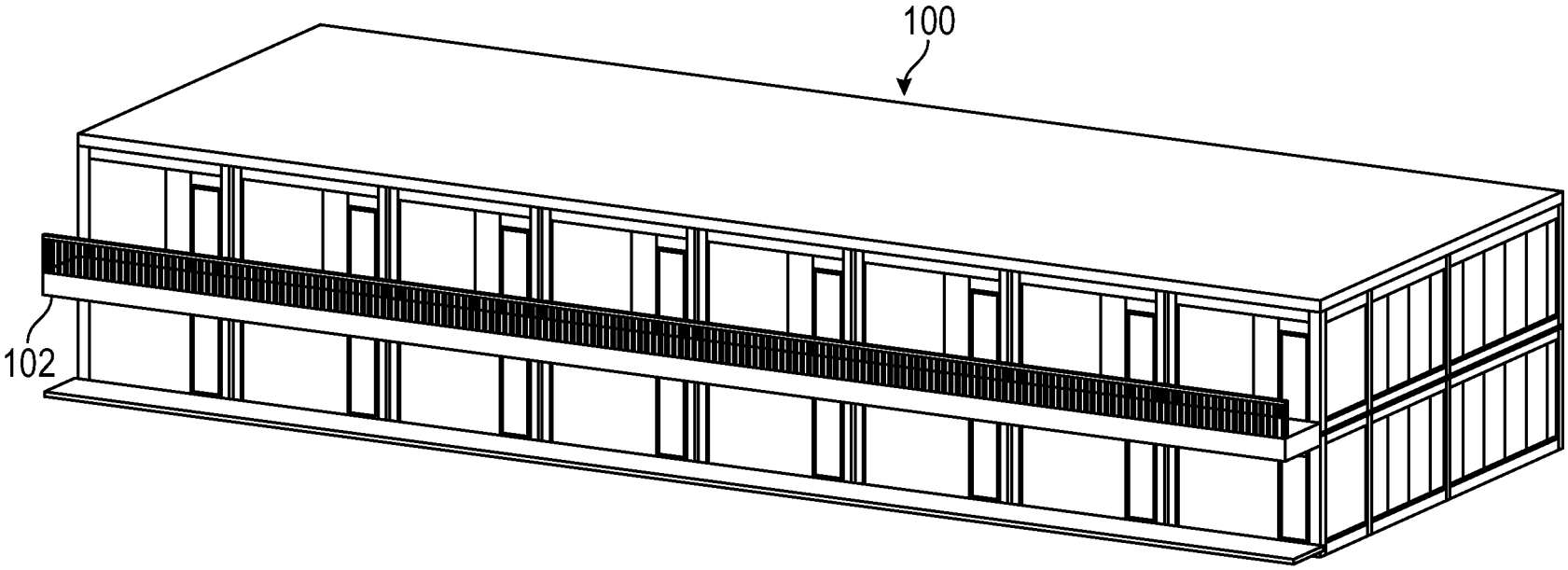
FIG. 11 is a perspective view of a completed modular construction comprising a balcony disposed between a first and second floor of the modular construction.

In FIGS. 5A and 5B, a modular construction 100 comprising two adjacently disposed modular units 1', 1" is seen with a pair of connection assemblies 10 coupling the modular units 1', 1" together and a plurality of cantilever beams 16 extending perpendicularly outward from a corresponding plurality of end plates 18. FIG. 5C shows an alternative embodiment of the modular construction 100' wherein the modular construction 100' comprises two stories, for example two adjacent top modular units 1', 1" disposed above two adjacent bottom units 2', 2". Each modular unit 1, 2 comprises a cantilever beam 16 coupled to a corresponding connection assembly 10, with the center most disposed connection assemblies 10 coupling the two adjacent bottom units 2', 2" together as well as accommodating the two adjacent top units 1', 1". Once coupled, the cantilever beams 16 may provide architectural support for any number of auxiliary or supplemental structures that are to be part of the modular construction 100, including but not limited to a corridor or hallway, a balcony 102 for the upper modular units as seen in FIG. 11, a patio or awning for the lower modular units, a sign or billboard to be disposed on the side of the modular construction, or any other desired construction element. Through the use of the cantilever plate 14 being inserted between the columns 1*b*, 2*b* of the upper and lower modular units 1, 2, the connection assembly 10 is able to provide a support element which is capable of bearing any related gravitational and moments of force or torque placed upon it by the modular construction 100.

Figure 4B:
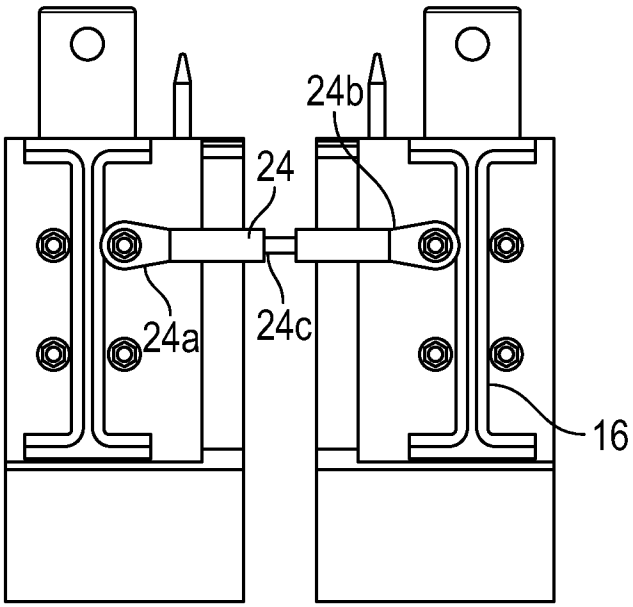
FIG. 4B is a frontal view of two adjacent modular units comprising the tie connection of FIG. 4A coupled to an end plate portion of a cantilever beam that is in turn coupled to a connection assembly of FIGS. 1-2D disposed on each of the modular units.
Figure 4A:
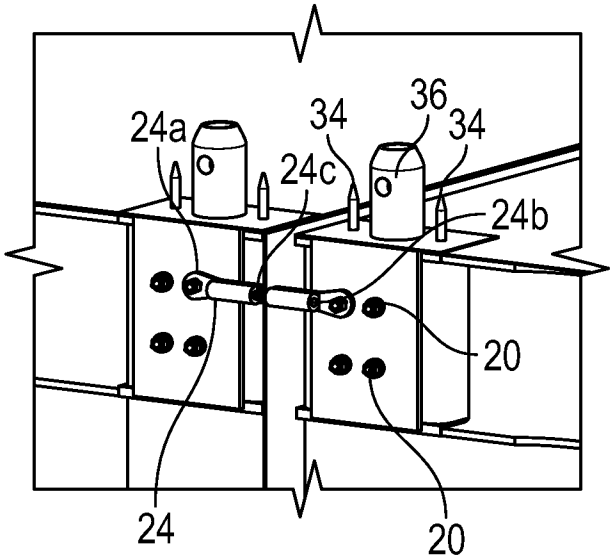
FIG. 4A is a magnified perspective view of two adjacent modular units comprising a tie connection comprising two halves, each half of the tie connection coupled directly to a face plate portion of the connection assembly of FIGS. 1-2D disposed on each of the modular units.
Figure 7B:
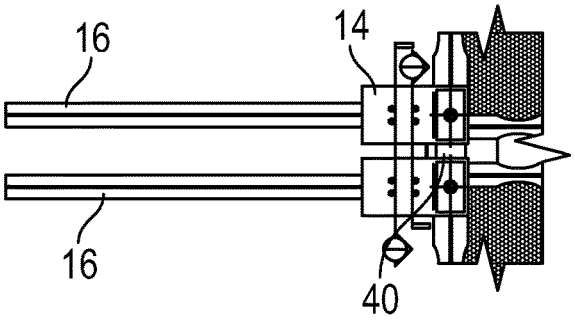
FIG. 7B is a top down view of the two adjacently disposed connection assemblies of FIG. 7A.
Figure 7C:
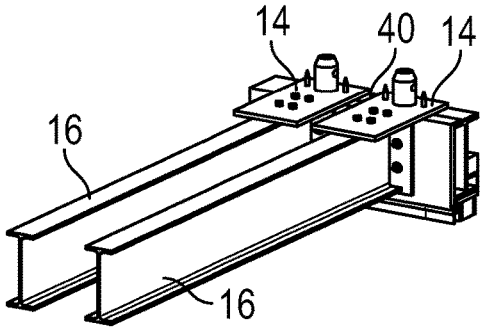
FIG. 7C is a perspective view of the two adjacently disposed connection assemblies of FIG. 7A.
Figure 9:
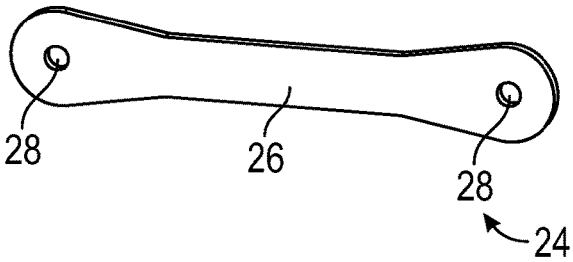
FIG. 9 is a perspective view of the tie connection of FIGS. 1 and 7A.

Turning to FIGS. 7A-7C as well as returning to FIG. 1, when two connection assemblies 10 of two adjacent modular units 1, 2 are closely disposed to another, a tie connection 24 is disposed between them in order to accommodate relative movement between the modular units 1, 2 during a seismic event. In certain embodiments, the tie connection 24 comprises an elongated body 26 and a matching or symmetrical pair of eyelets 28 that are disposed on either lateral end of the body 26. The body 26 is rigid and does not compress, bend, or fold when large longitudinal or rotational forces are applied to either lateral end of the body 26. In certain embodiments, the body 26 and the eyelets 28 may be relatively flat or thin so as to form a small profile with the respective connection assemblies 10, however in other embodiments both the body 26 and the eyelets 28 comprise a radius or a rounded thickness which in turn protrude from the surfaces of the connection assembly 10. In some embodiments, the tie connection 24 as seen in FIGS. 4A and 4B comprises two halves or parts 24*a*, 24*b* which are joined together by a central portion 24*c* which comprises a reduced diameter or cross section relative to the halves 24*a*, 24*b* of the tie connection 24 comprising the eyelets 28. In some embodiments, the tie connection 24 as seen in FIG. 9 comprises a substantially tapered shape, namely with the center of the body 26 comprising a first diameter or width which smoothly increases to a second diameter which comprises the eyelets 28.

The tie connection 24 in some embodiments is coupled to a pair of adjacently disposed end plate 18 portions of each connection assembly 10. In one embodiment, each eyelet 28 is disposed or threaded over a corresponding pair of bolts 20 that extends from the side plate 12 and through the end plate 18 before the nut 22 is coupled and then tightened thereto as best seen in FIG. 7A, thereby "sandwiching" each eyelet 28 between the nut 22 and the outward facing surface of the end plate 18. In another embodiment, each eyelet 28 comprises a sufficient diameter so as to accommodate both the bolt 20 and its corresponding nut 22, allowing the tie connection 24 to be installed after the cantilever beams 16 have been coupled to the side plates 12 as discussed above. In all embodiments, while each eyelet 28 is sufficiently sized as to accommodate either the diameter of a bolt 20 or the diameter of a bolt 20 in combination with the diameter of a nut 22, the eyelet 28 is sized to permit rotational movement about the bolt 20 and/or the bolt 20 and nut 22. Additionally, while FIG. 7A shows the tie connection 24 being coupled between an upper, outwardly disposed bolt 20 disposed through each adjacent end plate 18, it is to be expressly understood that the tie connection 24 may be coupled to any combination of bolts 20 disposed in either end plate 18. The coupling process for the tie connection 24 may be repeated for each of the modular units within the modular construction, namely between each of the horizontally disposed or adjacent modular units on each of the floors or levels within the modular construction. The connection assembly 10 and tie connection 24 are preferably disposed on both the front and back of each of the modular units within the overall modular construction, however in certain embodiments connection assemblies 10 and tie connections 24 may be used anywhere along the entire shared lengths of the modular units. In other words, the connection assemblies 10 and tie connectors 24 are preferably used to couple two adjacent modular units at their respective lateral ends, however in an alternative embodiment, one or more connection assemblies 10 and tie connectors 24 may also be disposed along their respective longitudinal lengths as well.

During a seismic event, any modular units 1, 2, within the modular construction will undergo both vertical and horizontal displacement for a possible extended amount of time. This can be devastating for modular units 1, 2 within a stacked modular construction since so little space is present between each of the units which can then result in repeated physical impact between modular units. However, because the tie connection 24 is disposed between two horizontally adjacent modular units and comprises a rigid, non-compressible body 26, any relative horizontal movement between each modular unit is reduced if not eliminated, thereby preventing impact between the modular units. Additionally, because each eyelet 28 of the tie connection 24 is free to rotate about its respective connection point or bolt 20, relative vertical movement between adjacent modular units is compensated for. Specifically, when two horizontally disposed modular units undergo a vertical displacement, the tie connection 24 disposed there between will rotate about its respective connection points accordingly via the eyelets 28 spinning or rotating about its corresponding bolt 20. In this manner, vertical movement of one modular unit relative to an adjacent modular unit is compensated by the eyelet 28 rotating a corresponding amount about the bolt 20 on the connection assembly 10 that is experiencing the vertical displacement. In certain embodiments, because both eyelets 28 of the tie connection 24 may rotate about their respective bolts 20, the tie connection 24 may rotate in both a clockwise and counterclockwise direction at either lateral end, alternating or in sequence, for the duration of the seismic event while still maintaining a rigid or inflexible support in the horizontal direction provided by the inflexible body 26 of the tie connection 24. After the seismic event, the modular units 1, 2 within the modular construction cease any relative vertical movement, allowing the tie connection 24 to return to a substantially horizontal position as seen in FIGS. 1 and 7A.

Figure 8:
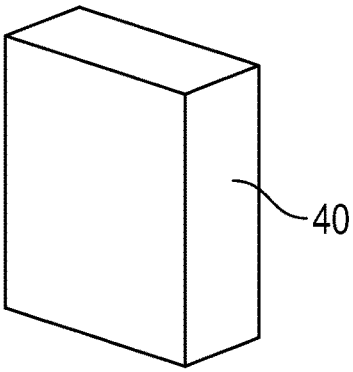
FIG. 8 is a perspective view of a removable pad which may be inserted in between two adjacent modular units of a modular construction.
Figure 10A:
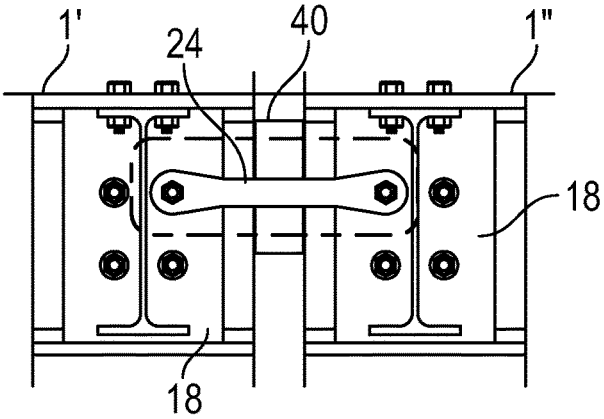
FIG. 10A is a frontal view of two adjacently disposed connection assemblies comprising the pad of FIG. 9 disposed there between when in an expanded configuration.
Figure 10B:
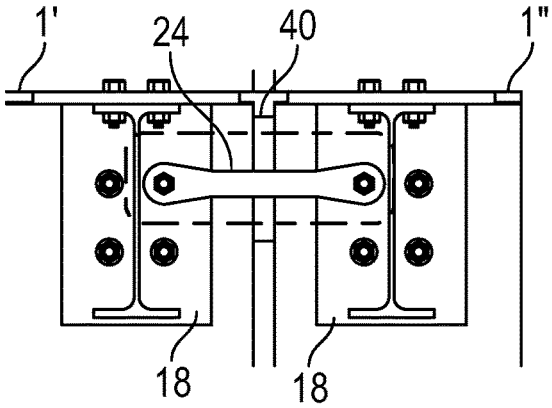
FIG. 10B is a frontal view of two adjacently disposed connection assemblies comprising the pad of FIG. 9 disposed there between when in a compressed configuration.

In certain other embodiments seen in FIGS. 7B, 7C, 10A, and 10B, a neoprene pad 40 is disposed between adjacent modular units 1, 2 and their respective connection assemblies 10. In one embodiment, the pad 40 is substantially rectangular or cuboid shape as seen in FIG. 8. The pad 40 in one particular embodiment comprises a first thickness of 2 and ⅜ inches as seen in FIG. 10A where the pad 40 is disposed between two adjacent modular units 1', 1" before a seismic event takes place. After the seismic event begins, the modular units 1', 1" may move closer together, thereby compressing the pad 40 to a second or smaller relative thickness of 1 inch as seen in FIG. 10B according to certain embodiments. After the seismic event ends, the modular units 1', 1" move apart and return to their original positions, thereby allowing the pad 40 to once again expand into the first thickness seen in FIG. 10A. However, according to certain other embodiments, the pad 40 comprises a different width, height, depth, or material other than what is explicitly shown so as to provide a different configuration or level of compression when undergoing stress during a seismic event. After installation, the pad 40 may further prevent impact between adjacent modular units by compressing and cushioning each adjacent modular unit during a seismic event.

Many alterations and modifications may be made by those having ordinary skill in the art without departing from the spirit and scope of the embodiments. Therefore, it must be understood that the illustrated embodiment has been set forth only for the purposes of example and that it should not be taken as limiting the embodiments as defined by the following embodiments and its various embodiments.

Therefore, it must be understood that the illustrated embodiment has been set forth only for the purposes of example and that it should not be taken as limiting the embodiments as defined by the following claims. For example, notwithstanding the fact that the elements of a claim are set forth below in a certain combination, it must be expressly understood that the embodiments includes other combinations of fewer, more or different elements, which are disclosed in above even when not initially claimed in such combinations. A teaching that two elements are combined in a claimed combination is further to be understood as also allowing for a claimed combination in which the two elements are not combined with each other, but may be used alone or combined in other combinations. The excision of any disclosed element of the embodiments is explicitly contemplated as within the scope of the embodiments.

The words used in this specification to describe the various embodiments are to be understood not only in the sense of their commonly defined meanings, but to include by special definition in this specification structure, material or acts beyond the scope of the commonly defined meanings. Thus if an element can be understood in the context of this specification as including more than one meaning, then its use in a claim must be understood as being generic to all possible meanings supported by the specification and by the word itself.

The definitions of the words or elements of the following claims are, therefore, defined in this specification to include not only the combination of elements which are literally set forth, but all equivalent structure, material or acts for performing substantially the same function in substantially the same way to obtain substantially the same result. In this sense it is therefore contemplated that an equivalent substitution of two or more elements may be made for any one of the elements in the claims below or that a single element may be substituted for two or more elements in a claim. Although elements may be described above as acting in certain combinations and even initially claimed as such, it is to be expressly understood that one or more elements from a claimed combination can in some cases be excised from the combination and that the claimed combination may be directed to a subcombination or variation of a subcombination.

Insubstantial changes from the claimed subject matter as viewed by a person with ordinary skill in the art, now known or later devised, are expressly contemplated as being equivalently within the scope of the claims. Therefore, obvious substitutions now or later known to one with ordinary skill in the art are defined to be within the scope of the defined elements.

The claims are thus to be understood to include what is specifically illustrated and described above, what is conceptionally equivalent, what can be obviously substituted and also what essentially incorporates the essential idea of the embodiments.

We claim:

1. A modular construction comprising:

at least two modular units;

a connection assembly coupled to each of the at least two modular units; and a tie connection coupled to each connection assembly coupled to each of at least two modular units, where the at least two modular units are disposed horizontally adjacent to each other, where the connection assembly coupled each of the at least two modular units comprises:

a side plate coupled to one of the at least two modular units;

a cantilever plate disposed on top of one of the at least two modular units;

a first plurality of fasteners configured to couple the cantilever plate to a cantilever beam;

an end plate coupled to the cantilever beam; and a second plurality of fasteners configured to couple the end plate coupled to the cantilever beam to the side plate coupled to each of the at least two modular units, and where the tie connection coupled to each connection assembly is coupled to the at least two of the second plurality of fasteners.

2. The connection assembly of claim 1 where the side plate is coupled to a vertical surface of a column of a first modular unit of the at least two modular units, and where the cantilever plate is disposed over a top surface of the column of the first modular unit.

3. The connection assembly of claim 1 where the end plate coupled to the cantilever beam is removably coupled to the side plate, and where the cantilever plate is removably coupled to the cantilever beam.

4. The connection assembly of claim 1 where the cantilever plate disposed on top of one of the at least two modular units is disposed across a corresponding cross sectional area of a first column within a first modular unit of the at least two modular units.

5. The connection assembly of claim 1 where the cantilever plate comprises:

at least one guide pin; and a cable pin, where the cable pin comprises a shaft defined through its vertical height.

6. The modular construction of claim 1 where the tie connection is configured to rotate about the at least two of the second plurality of fasteners.

7. The modular construction of claim 1 where the cantilever plate comprises:

at least one guide pin; and a cable pin, wherein the cable pin comprises a shaft defined through its vertical height.

8. A method for constructing a modular construction, the method comprising:

disposing a first modular unit horizontally adjacent to a second modular unit, where the first and second modular units each comprise a connection assembly, where each connection assembly comprises:

a side plate coupled to one of the at least two modular units;

a cantilever plate disposed on top of one of the at least two modular units;

a first plurality of fasteners configured to couple the cantilever plate to a cantilever beam;

an end plate coupled to the cantilever beam; and a second plurality of fasteners configured to couple the end plate coupled to the cantilever beam to the side plate coupled to each of the at least two modular units;

disposing a cantilever plate on a top surface of the first and second modular units;

stacking a third modular unit on top of the cantilever plate disposed on either the first or second modular unit; and coupling a tie connector to each connection assembly of the first and second modular units, where the tie connector coupled to each connection assembly is coupled to at least two of the second plurality of fasteners.

9. The method of claim 8 further comprising disposing a compressible pad between the first and second modular units.

10. The method of claim 8 further comprising:

coupling a cantilever beam to the cantilever plate disposed on either the first or second modular unit; and coupling the cantilever beam to a side plate coupled to either the first or second modular unit.

11. The method of claim 8 where stacking the third modular unit on top of the cantilever plate disposed on either the first or second modular unit comprises inserting at least one guide pin disposed on the cantilever plate into the third modular unit.

12. The method of claim 8 where stacking the third modular unit on top of the cantilever plate disposed on either the first or second modular unit comprises:

inserting a cable pin disposed on the cantilever plate into the third modular unit; and disposing a conduit within the third modular unit through a shaft defined through a vertical height of the cable pin and into either the first or second modular unit.

13. The method of claim 8 further comprising compensating for relative vertical movement between the first and second modular units by rotating each lateral end of the tie connector about the at least one fastener disposed on the first modular unit and the at least one fastener disposed on the second modular unit, respectively.

* * * * *